US007627992B1

(12) United States Patent
Gavin

(10) Patent No.: US 7,627,992 B1
(45) Date of Patent: Dec. 8, 2009

(54) STACKABLE RISER AND COVER CONFIGURATION

(75) Inventor: Peter W. Gavin, 22 Pent Rd., Durham, CT (US) 06422

(73) Assignee: Peter W. Gavin, Durham, CT (US)

( * ) Notice: Subject to any disclaimer, the term of this patent is extended or adjusted under 35 U.S.C. 154(b) by 909 days.

(21) Appl. No.: 10/982,466

(22) Filed: Nov. 5, 2004

(51) Int. Cl.
*E02D 29/14* (2006.01)
*B65D 6/28* (2006.01)

(52) U.S. Cl. ..... 52/20; 52/592.6; 220/4.26; 404/25; 174/39

(58) Field of Classification Search ..... 52/20, 52/19, 592.6, 848, 98, 100, 141, 169.6; 220/220, 220/516, 4.26, 4.27, 4.03; 404/25, 41, 80, 404/83, 134, 136, 137; 405/53; 174/37, 174/39
See application file for complete search history.

(56) References Cited

U.S. PATENT DOCUMENTS 4,572,368 A * 2/1986 Miller et al. ..... 206/708
5,617,679 A * 4/1997 Meyers ..... 52/20
5,628,152 A * 5/1997 Bowman ..... 52/20
5,852,901 A * 12/1998 Meyers ..... 52/20
6,195,944 B1 3/2001 Goldthorpe
6,484,451 B1 * 11/2002 Gavin ..... 52/20
6,655,093 B1 * 12/2003 Gavin ..... 52/20
6,688,072 B1 * 2/2004 Gavin ..... 52/742.14
6,877,281 B1 * 4/2005 Gavin ..... 52/19
6,986,227 B1 * 1/2006 Gavin ..... 52/20
2003/0145527 A1 * 8/2003 Meyers ..... 52/20

* cited by examiner

*Primary Examiner*—Robert J Canfield
*Assistant Examiner*—Babajide Demuren
(74) *Attorney, Agent, or Firm*—Jenner & Block, LLP

(57) ABSTRACT

A stackable riser section having a single side wall having a first open end defined by an edge and a second open, channel end. The riser section includes a plurality of bosses extending to the first open end and connected to an interior surface of the sidewall by narrow webs. A channel, on the channel end of one riser is adapted to receive the bosses of a mated riser. A wall defining the boss receiving channel has a plurality of slots with at least a portion defined by parallel edges. The slots receive the webs that connect the bosses to the riser sidewall. The bosses are wider than the portion of the slots defined by the parallel edges. The slotted wall includes thickened wedge portions to snugly fit with the first open end of another riser section. A cover is disclosed that includes the same channel end to coact with the first open end of a riser section.

45 Claims, 3 Drawing Sheets

STACKABLE RISER AND COVER CONFIGURATION

BACKGROUND OF THE INVENTION

1. Field of the Invention

The present invention pertains to stackable riser sections and riser covers for creating access risers. More particularly, the present invention pertains to the structural elements of a riser section for connecting a series of riser sections to each other, and to an upper cover.

2. Discussion

Stackable risers are used to provide access to underground containments or vessels made of concrete, typically associated with septic systems, and/or underground electrical or communications systems. Riser sections are disclosed in U.S. Pat. Nos. 6,484,451 and 6,655,093. The latter patent also discloses a riser cover. The content of these patents is hereby incorporated by reference into this specification.

Injection molded, plastic, stackable riser sections made of high density polyethylene and other rigid, light weight polymeric material are known in the art and provide access to underground vessels. Riser sections can be manufactured in various heights and diameters, and a series of identically sized riser sections can be stacked to achieve a desired depth. A removable cover is provided on the top riser of a stack to permit access to the underground vessel.

Depending on the soil characteristics and overhead traffic, the vertical, horizontal, and rotational forces placed upon these riser sections can be considerable. It is important to continually evolve the riser structure design to maximize the resistance of the riser and cover stack to these loads.

The riser section and riser cover disclosed for example in U.S. Pat. No. 6,655,093 represent a satisfactory system for providing access to underground vessels. Evolution of these products has resulted in riser section and cover combinations which display superior load carrying capabilities and which can be reliably manufactured by the same molding processes as have been previously used. The present invention is directed to such combinations.

The stackable riser sections of the present invention have a hollow, cylindrical sidewall configuration, although configurations other than cylindrical may be used. The sidewall of the riser section includes a channel end and a blunt end which interengage or nest with adjacent riser sections to form a vertical stack.

The blunt end of the riser section sidewall, usually the upper end, terminates in a blunt, or square, end that defines a flat annular edge surface. The blunt end of the riser section sidewall is configured to mate with the channel end of either another riser section or a cover.

The opposite, channel, end of the riser section, usually the bottom, includes two adjoining channels defined by interior, slotted middle, and truncated exterior wall portions that extend down from a horizontal ledge portion extending inwardly from the sidewall. The wall portions of the channel end project concentrically with, or (in the case of riser sections having, for example, a square or rectangular cross-section) parallel to, the sidewall.

The radially outer channel is defined between the slotted middle wall and the truncated exterior wall. The truncated exterior wall defines a downwardly facing flat annular edge surface adopted to be disposed in closely spaced facing relation to the flat annular edge surface of the blunt end of an adjacent riser when stacked together.

The outer channel is shallower than the inner channel and is, in essence, a seal groove. It accepts a resilient seal element.

The seal element is compressed against the flat annular edge surface of the blunt end of an adjacent riser to effect a water-tight and gas-tight seal between two stacked riser sections (or between a riser section and a cover).

A plurality of spaced, vertical support bosses are connected to the interior surface of the cylindrical sidewall of the riser by webs that are narrow relative to the circumferential width of the bosses. The bosses extend from the horizontal ledge portion at or near the channel end to the flat annular edge surface at the blunt end of the riser section sidewall. The bosses strengthen the sidewall and provide vertical support for an adjacent upper riser section.

The radially inner channel is substantially larger than the outer channel, and accepts the interior vertical support bosses of a riser section on which it rests. Portions of the slots of the middle wall of the channel end are defined by parallel side edges spaced apart a distance narrower than the bosses but wider than the webs. The slots receive the webs that connect the bosses to the sidewall to permit positioning of the bosses within the inner channel of an adjacent riser section positioned above it with the portions of the slotted wall defining parallel edges positioned between the bosses and sidewall of the lower riser section. At the interconnection between each pair of stacked riser sections the webs of the bosses interengage with the slots of the slotted middle wall of the associated stacked riser. Radial or horizontal loads are received by the slotted middle wall at the portions defining the parallel slot defining edges.

The inner wall portion is an annular member with significant hoop strength. Loads imparted to the middle wall portion by the bosses are shared with the inner wall through the connecting ledge portion.

The bosses are displaced radially inward of the slotted middle wall and capture the middle wall of a stacked riser section between the inner surface of the riser side wall and the radial outer surface of the bosses. The slotted middle wall includes thickened wedge portions which frictionally engage the bosses when one riser section is fully nested on another riser section. This ensures a snug fit. The cover is arranged to provide this same fit with a top riser section.

Projections on the bottom of the horizontal ledge portion in the inner channel are aligned with the slots and support the upper riser section on the bosses of the lower riser section. The projections transfer downward forces from above to the top ends of the bosses located below the projections.

A cover is adapted to be secured to the top of the uppermost riser section. Like the stackable riser, the preferred shape is cylindrical, but other configurations, such as square, rectangular or elliptical may be used with correspondingly shaped riser sections.

The cover has a top surface and a bottom surface, with the top surface being nearly smooth and slightly convex. A sidewall of the cover depends from the top surface. It includes a channel end similar to the channel end of the riser sections. The channel end includes two adjacent concentric channels defined by inner, slotted middle and outer truncated wall portions. The truncated outer wall defines the sidewall outer surface of the cover and terminates in a downwardly facing flat annular edge surface similar to the flat annular edge surface on the upper blunt end of the riser sidewall. A seal is located in the outer channel and is compressed by the flat annular edge surface of the lower riser when the cover and riser sections are nested together.

The cover inner channel is defined between the inner wall and the slotted middle wall. It receives the bosses of the riser section below the cover. Projections similar to the projections in the inner channel of a riser section are provided in the inner channel of the cover. They are aligned with the slots of the middle wall. The projections contact the upper end of the bosses of the riser section below the cover and transfer vertical loads imparted to the cover to the bosses below the projections. The inner channel also includes spaced radial webs extending between the middle wall and the inner wall adjacent each slot. These webs transfer load between these walls.

Each boss may be adapted to receive a screw, or other fastener, that extends through the horizontal ledge portion of a riser section stacked above the blunt end for securing the upper riser section to the lower riser section. The bosses also may receive a screw to attach a cover at the top of a riser stack.

Other features, objects and advantages of the invention will become apparent from the following description and drawings in which the details of the invention are fully and completely disclosed as part of this specification.

DETAILED DESCRIPTION OF PREFERRED EMBODIMENTS

Figure 1:
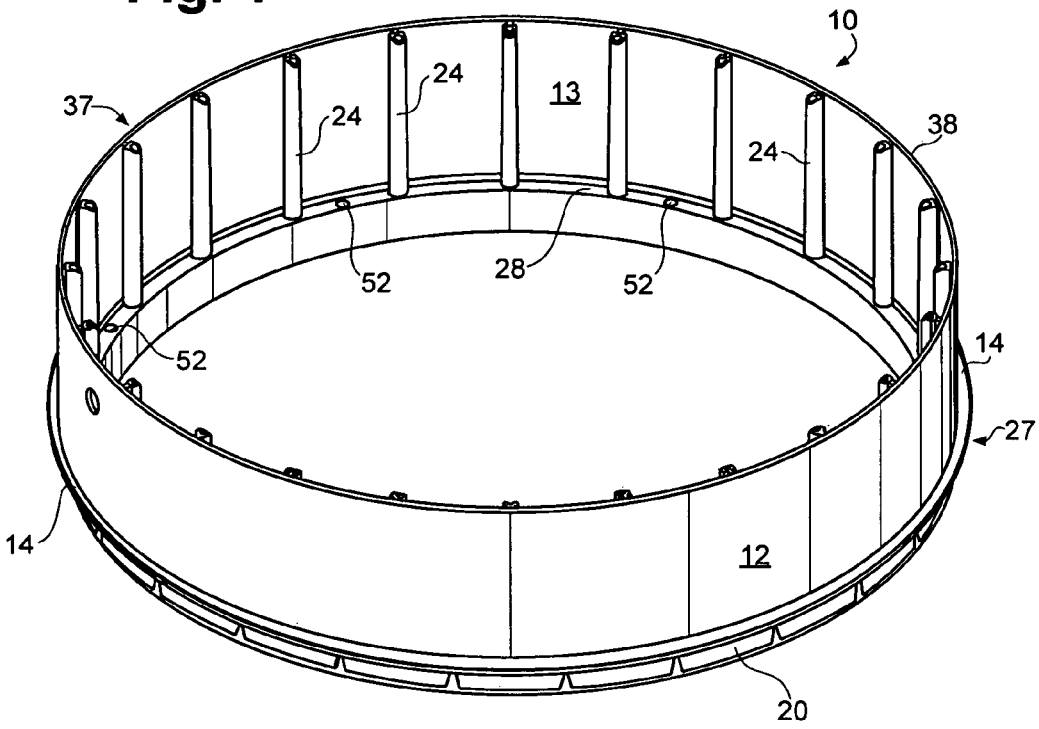
FIG. 1 is a perspective view of a riser section embodying the principles of the present invention.

Terms such as upper and lower, top and bottom, above and below, as used to describe the illustrated embodiment have their ordinary and usual meanings and are applied to riser sections and covers as they would normally be oriented in association with an underground component such as a concrete septic tank. The riser sections and covers illustrated are generally cylindrical and concentric about an imaginary vertical axis or centerline. Terms such as inner, internal or interior, mean toward the centerline, and outer, external or exterior mean away from the centerline. Reference to radial means on a line passing through the imaginary centerline, perpendicular to it. Circumferential means on a line in a plane perpendicular to the imaginary centerline, the points of which are equidistant from the imaginary centerline.

It should be noted that the riser sections and cover described are each integrally molded as a single piece. The reference herein to portions of a riser section, or cover, are for purposes of clarity of description and understanding of the specific portions of these structures and their interrelationship.

Shapes other than cylindrical are of course within the scope of the invention. For example, the riser section and associated cover could be of a square shape.

Referring to FIGS. 1-5, in the preferred embodiment of the present invention, a riser section 10 includes generally cylindrical sidewall portion 12 with an inner surface 13. The riser section is, with the exception of the features described below the same as the riser section disclosed in U.S. Pat. Nos. 6,484,451 and 6,655,093.

Sidewall portion 12 has a first upper, or blunt end 37, and a second, bottom, or channel end 27. Alternatively, without departing from the invention, the end 37 of a riser could be on the bottom and the channel end 27 could be on the top. Riser sections 10 are intended to be stacked one on the other to form a riser passage. The blunt end 37 of each riser is configured or sized to mate with or nest in the channel end 27 of an adjacent riser section stacked above it. The top riser section receives a cover generally designated 50, as is well known.

Figure 3:
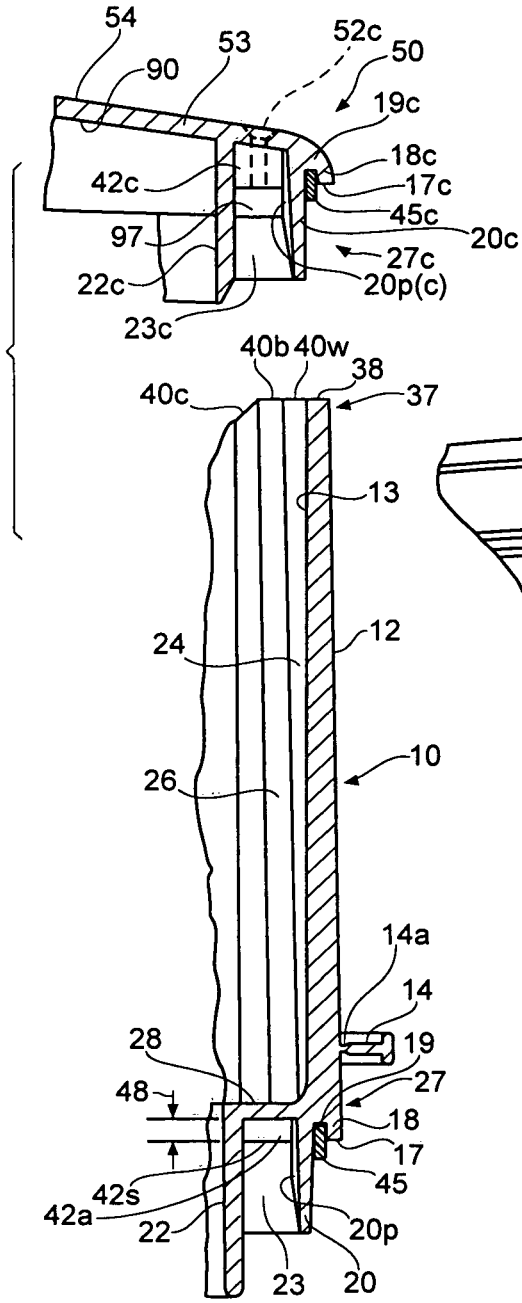
FIG. 3 is fragmentary sectional plan view of the riser section of FIG. 1 and riser cover associated therewith embodying the principles of the present invention.
Figure 4:
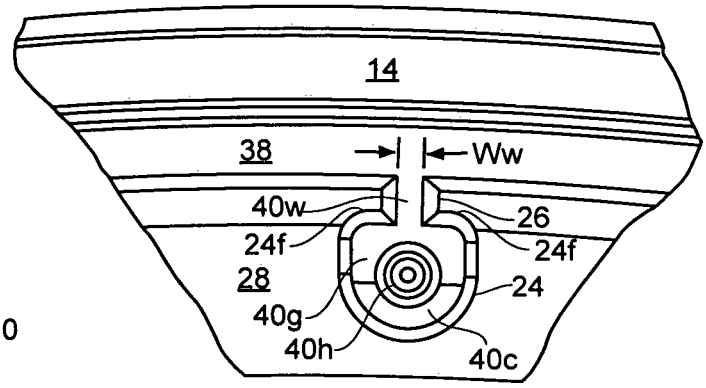
FIG. 4 is a fragmentary top view, on an enlarged scale, of a portion of the riser section of FIGS. 1 and 3 further illustrating features of the present invention.

In the preferred embodiment, upper blunt end 37 includes an upwardly facing flat annular edge surface 38 best seen in FIGS. 3 and 4, substantially perpendicular to the imaginary vertical axis of the riser section. Flat annular edge surface 38 extends around the entire upper blunt end 37 of sidewall 12. It coacts with the adjacent riser in a stack as described in detail below.

A plurality of vertical bosses 24 are connected to the interior surface of sidewall portion 12 by vertical offsetting portions or webs 26, best seen in FIG. 4. Offsetting portions or webs 26 extend from the inside surface 13 of sidewall 12 to the boss 24. As shown in FIG. 3, the bosses 24 and offsetting portions or webs 26, run along the full vertical height of the sidewall 12 from ledge portion 28 to flat annular edge surface 38. At blunt end 37 of riser section 10, the bosses 24 and webs 26 include flat end surfaces 40*b* and 40*w*. The surfaces 40*b* and 40*w* of vertical bosses 24 and connecting webs 26 are flush with the flat annular edge surface 38 at the blunt end 37 of sidewall 12. As shown in FIGS. 1 and 3, the bosses include a chamfer 40*c* that provides a transition between the flat surface 40*b* and the vertical extent of the boss 24 and web 26.

The bosses 24 are wider in the circumferential direction than the connecting webs 26. Thus, radially outward surfaces 24*f*, adjacent each side of offsetting portions 26, best seen in FIG. 4, face the inner surface 13 of sidewall 12 and form a slot or gap to receive the middle wall portion 20 of another riser section as will be explained.

In the illustrated embodiment, twenty-four bosses are provided on the interior surface of sidewall 12. There is a boss every 15° (degrees) around the sidewall.

Figure 2:
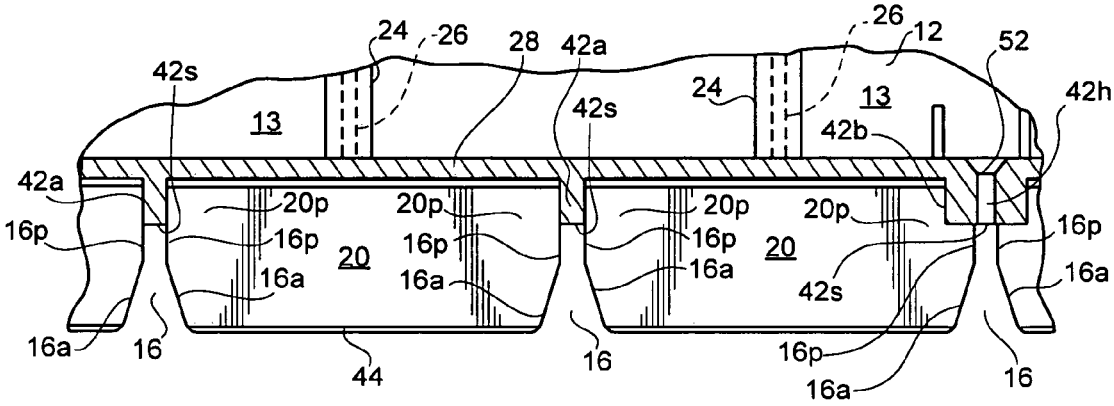
FIG. 2 is a sectional plan view, on an enlarged scale, of a portion of the riser section of FIG. 1, illustrating features of the present invention.

Referring to FIGS. 1-5, the channel end 27 of riser section 10 comprises a channel arrangement having outer or truncated wall portion 18, a slotted middle wall portion 20, and inner wall portion 22 that extend downward relative to internal horizontal ledge portion 28, and generally parallel to the sidewall 12. Horizontal ledge portion 28 extends radially inward from inner surface 13 of the riser sidewall 12 at the channel end 27. It is generally perpendicular to the imaginary vertical centerline and the sidewall. As seen in FIGS. 1 and 2, the upper surface of ledge portion 28 includes screw holes 52 to receive fasteners to connect stacked riser sections together as will be explained. The screw holes are positioned at 60° (degrees) intervals. Thus six such holes are present.

Outer wall 18 of channel end 27 is relatively short compared to the other walls. It includes a downward facing flat annular edge surface 17 and defines, with middle wall portion 20, outer, channel or seal groove 19. Slotted middle wall portion 20 and inner wall portion 22 define, with ledge portion 28, inner channel 23.

Inner wall portion 22 extends from the radially inward terminus of horizontal ledge 28. It is of a generally rectangular cross section, best seen in FIG. 3. It is longer in the axial direction than the middle wall portion 20. It has a radial thickness that is about the same or slightly less than the thickness of the sidewall 12. It is an element of the riser section 10 that possesses significant hoop strength. For that reason, it is able to absorb radial forces imparted from the riser section below it.

Figure 5:
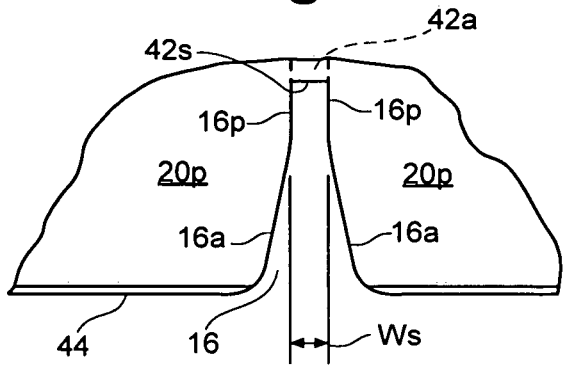
FIG. 5 is a fragmentary plan view, on an enlarged scale, of a portion of the riser section of FIGS. 1 and 3 illustrating features of the present invention.

As shown in FIGS. 2 and 5, channel end 27 of the present invention includes slotted middle wall portion 20 having slots 16 at regular intervals that divide the middle wall portion into a plurality of segments. The slots 16 are spaced in middle wall 20 of a first riser section 10 such that they align with, and receive offsetting portions or webs 26 of bosses 24 of blunt end 37 of a second riser section 10 when the first riser section is mated with, or nested on top of the second riser section. When so assembled, the bosses 24 of the second riser section 10 are disposed radially inward of the inner surface of middle wall portion 20 and thereby extend into inner channel 23 of the first riser section 10 radially outward of inner wall portion 22. In the illustrated embodiment, twenty-four slots are provided to coincide with the number of bosses.

As illustrated in FIGS. 1 and 3 each segment of middle wall portion 20 includes a thickened wall wedge portion 20*p* adjacent each side of slot 16. The wall portion 20 is about 0.040 to 0.050 inches thicker in the radial direction in the area of each thickened wedge portion 20*p* than the rest of the wall portion 20. This thickened wedge area coacts with the radially outward surfaces 24*f* of bosses 24 to cause a wedging or friction contact. This relationship ensures a snug fit between stacked riser sections 10 on nesting of one upon another.

Projections 42*a* and 42*b*, best seen in FIGS. 2 and 3, extend downward from ledge portion 28 at each slot 16 and terminate in a support surface 42*s*.

With reference to FIGS. 2 and 5, each slot 16 extends from an open end at the bottom edge 44 of wall portion 20 to a terminus edge defined by the wall portion, coextensive, or co-planar with support surface 42*s* of a projection 42*a* or 42*b*. Each slot is formed by parallel slot edges 16*p* that extend from the upper terminus edge to the point of intersection with angled slot edges 16*a* which diverge toward wall edge 44 and define a widening, or diverging slot from the point of intersection to the edge 44. The parallel edges are spaced apart a circumferential distance only sufficient to receive offsetting portions or connecting webs 26 of a boss 24. Thus, when the channel end 27 of one riser section 10 is nested onto the blunt end 37 of another riser section 10 the connecting webs 26 are captured in the circumferential direction between the parallel edges 16*p* of slots 16. The middle wall portion 20 adjacent each parallel edge 16*p* is captured in the radial direction, between the radially outer surfaces 24*f* of the bosses 24 adjacent a connecting web 26 and the radially inner surface 13 of the sidewall 12.

The upper terminus edge of each slot 16 is flush with or coplanar with the support surface 42*s* of a vertical projection 42 in inner channel 23. The projections extend into channel 23 a distance designated 48 in FIG. 3 such that when a riser section is nested on top of another riser section, the surfaces 24*b* of bosses 24 contact and support the surfaces 42*s* within channel 23. Thus, vertical load transfer from an upper riser section 10, to a lower riser section 10 occurs at the support between the surfaces 42*s* of projections 42*a* and 42*b* and the upper surfaces 24*b* of bosses 24. The surfaces 26*w* of webs 24 similarly rest on the upper terminus edge of the slot 16 in which they are positioned because surfaces 26*w* are co-planar with surfaces 24*b* of bosses 24 and the upper terminus edge of each slot is coplanar with surface 42*s* of each projection 42*a* or 42*b*.

Slots 16 and corresponding projections 42 are spaced midway between bosses 24 on a given riser section.

As shown in FIG. 4, the vertical bosses 24 each contain on their end 40*b* a hollow bore 40*h* adapted to accept a screw, or other suitable fastener. Projections 42*b* provided in riser section 10 each align with a boss 24 of another riser section 10 when stacked. Such projections contain a hollow bore 42*h*, best seen in FIG. 2, so that a screw or other suitable fastener (not shown) can be inserted through projection 42*b* from hole 52 in ledge portion 28 in the first riser section 10 into the top end of a boss 24 below it in a second riser section 10 to fasten the two riser sections together.

As shown in FIG. 1, there are twenty-four vertical bosses 24 disposed about the interior surface of sidewall 12 of each riser section. There are also twenty-four slots 16 in middle wall 20. The slots in middle wall 20 are located midway between bosses 24 that extend upward from ledge 28. Thus when assembled, a riser is rotated or offset 7½° (degrees) relative to the riser section above it or below it. Each of the six holes 52 in ledge 28 are formed over a projection 42*b*. Each such projection rests on a boss 24 of the riser section below it. The fasteners such as screws can be inserted into holes 52 and secured in the holes 40*h* in the bosses 24 below the projections 42*b*.

Additional riser sections 10 can be stacked above or below the first and second riser sections, as desired. In each case, the upper riser section is rotated relative to the lower riser section to permit positioning of the offsetting portions 26 of the bosses 24 of the lower riser section within slots 16 of the middle wall portion 20 upper riser section.

The relatively narrow circumferential width of slots 16 at parallel edges 16*p* in middle wall 20, as shown in FIGS. 2 and 5, substantially limits any rotation of riser section 10 with respect to another riser section 10 stacked above or below the first riser section because the offsetting portions 26 of bosses 24 pass into and are restricted against movement by the parallel slot edges 16*p* of slots 16. Also, middle wall portion 22 captured between the inner surface 13 of sidewall 12 and the radially outer surfaces 24*f* of bosses 24 at the parallel slot edges 16*p* capture the middle wall 20 and provide for transfer of lateral or horizontal forces.

Referring to FIG. 3, when the upper end 37 of one riser section 10 and channel end 27 of another riser section 10 are mated, flat annular edge surface 38 of blunt end 37 is disposed in facing relation to downwardly facing flat annular edge surface 17 of outer wall 18 of the upper riser section. The diameter of the outer surface of middle wall 20 is such that it fits inside the interior surface 13 of the sidewall 12 of the riser 10 in closely spaced relation. The flat annular edge surface 38 is disposed in closely spaced, facing relation to the downwardly facing flat annular surface 17 of the outer truncated wall 18 of channel end 27. Because the flat annular edge surface 38 extends nearly to the outer surface of middle wall 20, outer channel 19 defines a seal grove or pocket closed at its bottom by flat annular edge surface 38 of an adjacent riser when the risers are assembled.

An annular seal 45 shown in cross section in FIG. 3 is installed in the seal groove or channel 19 before the riser sections are joined. The seal is preferably made of closed cell polyurethane foam and has a rectangular cross section that is larger in vertical direction than it is wide in the radial direction. The seal height is about ¼ inch. Its radial width is about ⅛ inch. As can be appreciated, the channel 19 is, therefore, closely proximate and its radial width is about ⅛ inch as is its depth upward from flat annular edge surface 17. Thus, when assembled into the groove 19, about half of the vertical extent of the seal 45 extends from the channel. As the upper end 37 of one riser is assembled into the channel end 27 of another riser, the upper annular surface 38 compresses seal 45 into seal groove or outer channel 19 to provide a substantially water and gas tight seal between the components.

If desired, sealant can be applied to the area where the end 37 of a first riser section 10 is disposed adjacent the outer channel 19 of another riser section 10 stacked on top of the first riser section 10 to further ensure a water-tight, gas-tight seal between adjacent riser sections 10 (or between a riser section 10 and a cover 50).

When two riser sections 10 are placed one on top of the other, each slot 16 can accept, referring now to FIGS. 2, 3 and 5, top edge 40*w* of offsetting portion or connecting web 26 of a boss 24. As best seen in FIG. 1, the riser illustrated includes 24 of the bosses 24 which are spaced at 15° (degree) intervals about the interior surface 13 of sidewall 12. Thus, there is a boss 24 located every 15° (degrees) about the interior surface of the sidewall 16. Slots 16 and corresponding projections 42*a* and 42*b* are spaced midway between adjacent bosses 24. Such slots and projections are, therefore, also positioned every 15° (degrees) about the horizontal ledge portion 28 but displaced 7½° (degrees) from the position of the bosses 24.

Referring to FIG. 3, channel end 27 of an upper riser section 10 receives the end 37 of another riser section 10 disposed below it with bosses 24 in channel 23. Bosses 24 of lower riser section 10 are aligned with, and support, projections 42*a* and 42*b* of the upper riser section 10. The two sections are secured together with screws that extend through openings 52 and hollow bores 42*h* in projections 42*b* into hollow bores 40*h* in bosses 24.

As best seen in FIG. 2, the height of projections 42*a* and 42*b* is such that the edges 42*s* of projections 42*a* or 42*b* abut against edges 40*b* and 40*w* of bosses 24, and webs 26 respectively, of another riser. Accordingly, a load from an upper riser section 10 is supported from below by the full height of bosses 24 and by the height of projections 42*a*, 42*b*, and ledge portion 28 of the riser section below it. The sidewall does not directly receive vertical loads.

As an upper riser 10 is rested upon a lower riser, the wedge surfaces 20*p* contact the inner facing surfaces of bosses 24. A wedging action occurs as the upper riser is moved to its fully mated or nested position with surfaces 42*s* of projections 42*a* and 42*b* resting on surface 40*b* of bosses 24. It begins when the upper riser section is about ½ inch from its fully nested position that is, when the support surfaces 42*s* of projections 42*a* and 42*b* of one riser section are about ½ inch from flat end surfaces 40*b* and 40*w* of the bosses 24 and webs 26 of another riser section. This wedging or frictional contact slightly deforms the segments of slotted wall portion 20 radially outwardly. Restoring forces existing in the segments exert a force toward the surfaces 24*f* to cause the segments of the molded polymeric wall to frictionally engage the upper extent of the bosses along surfaces 24*f*. This ensures a snug fit between stacked risers.

Referring to FIG. 1, detachable anchor tab 14 runs along the outside surface of the sidewall 12. The bottom-most riser section 10 within a vertical stack may be anchored in concrete (e.g., a concrete septic tank not shown), in which case anchor tab 14 serves to anchor the bottom-most riser section 10 within the concrete.

Preferably, anchor tab 14 is attached to the outside of sidewall 12 by a weakened region 14*a*, such that it can be removed from the sidewall 12. Anchor tab 14 is preferably completely removed from riser section 10 when riser section 10 is not intended to be anchored in concrete. Detaching anchor tab 14 from each of the riser sections placed above the bottom-most riser section (i.e., all of the riser sections except the bottom one that is anchored in concrete) enhances the stability of the entire stack by providing a substantially smooth external surface that is less susceptible to forces caused by ground heaving and shifting than if the external surface contained the anchor tabs 14 (or any other projecting elements, such as support ribs). In this way, the alignment and integrity of the overall riser stack is maintained in areas subject to soil movement caused by freezing and thawing or heavy traffic over the top of the riser.

Figure 6:
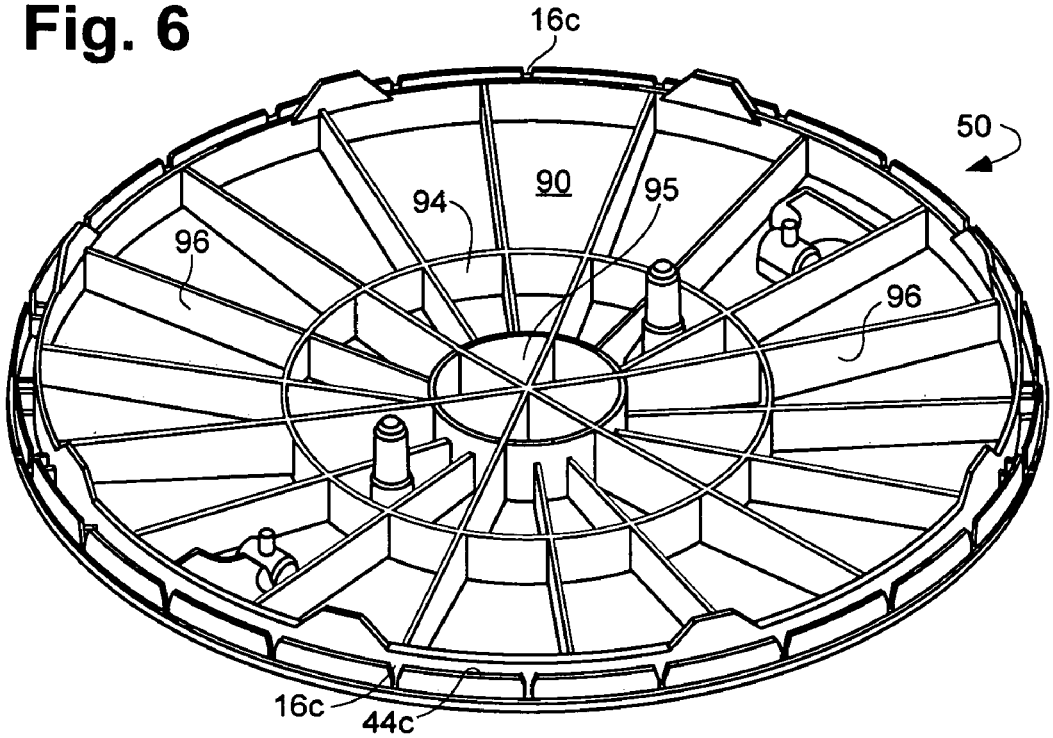
FIG. 6 is a perspective view of the riser cover illustrating features of the present invention.
Figure 7:
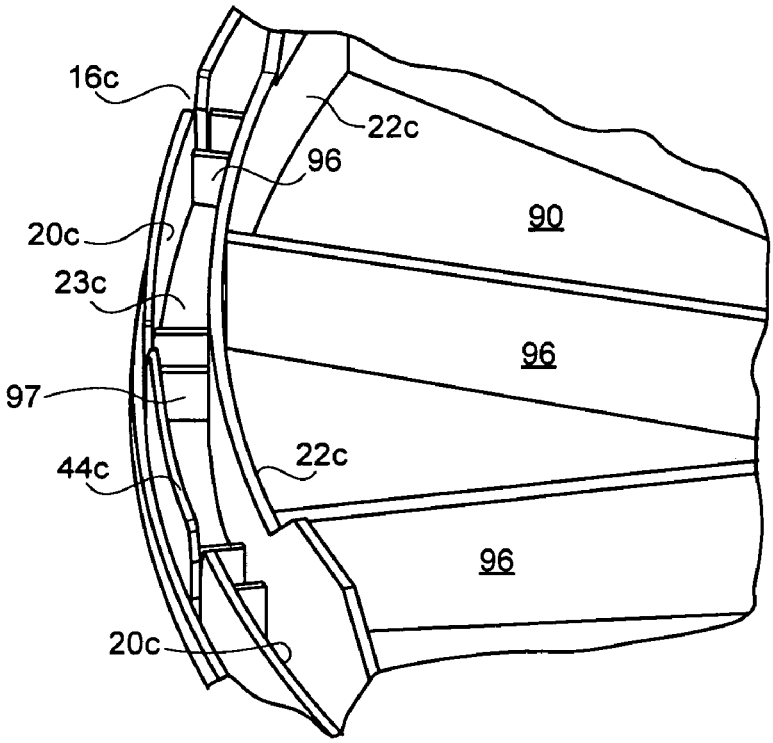
FIG. 7 is a fragmentary perspective view, on an enlarged scale, of the cover illustrated in FIG. 6 further illustrating features of the present invention.

A riser cover 50, best seen in FIGS. 3, 6 and 7, covers the uppermost riser section 10 in a stack of riser sections 10. Preferably, the cover is made from the same material as the associated riser sections, namely, integrally molded high density plastic, such as polyethylene.

The cover 50 includes a channel end generally designated 27*c* similar configuration as the channel end 27 of riser sections. In an alternate configuration, the cover 50 will have an end with the same configuration as blunt end 37 of riser sections 10 and the top of the associated riser section will define a channel end such as end 27.

Referring now to FIGS. 3, 6 and 7, there is shown a riser cover 50 of the present invention for removably closing the access to an underground component through a riser formed by stacked riser sections 10. Riser cover 50 is shown as circular in the preferred embodiment but can be of another shape that corresponds to the shape of the riser section to be covered. It is, except for the features described below, the same as the cover disclosed in U.S. Pat. No. 6,655,093 the content of which is hereby incorporated by reference.

Riser cover 50 includes a wall 53 defining a top convex surface 54, a bottom concave surface 90. A channel end 27*c* similar to channel end 27 of riser section 10 of FIGS. 1-5 depends from wall 53. Channel end 27*c* is the same as the channel end 27 described above and coacts with the blunt end 37 of a riser section 10 in the same way as the channel end 27 of one riser section 10 coacts with the blunt end 37 of riser section 10 are stacked together.

Channel end 27*c* includes a truncated outer wall 18*c* that defines the smooth outer peripheral surface of the cover. It ends in a downwardly facing flat annular edge surface 17*c*.

Channel end 27*c* includes a slotted middle wall 20*c* spaced inward of outer wall 18*c* that includes spaced slots 16*c* shaped and spaced as the slots 16 in middle wall 20 of a riser section 10 of FIGS. 1-5 that divide the wall into segments. It defines, with outer wall 18*c*, outer channel or seal groove 19*c* that receives a seal 45*c*. Channel end 27*c* includes inner wall 22*c* similar to inner wall 22 of channel end 27 of a riser section 10. It defines with middle wall 20*c*, inner channel 23*c*. Wall 20*c* includes thickened wedge portions 20*p*(*c*) on each side of each slot 16*c*. On placement of a cover 50 on a riser 10, these portions wedge against the facing surfaces 24*f* of bosses 24 of the riser section to ensure a snug fit of the cover 50 on the riser section 10.

Projections 42*c*, best seen in FIG. 3, are located within inner channel 23*c* on riser cover 50. The projections 42*c* are the same as the projections 42*a* and 42*b* of the riser section 10. A projection 42*c* is positioned at the upper terminus edge of each slot 16*c*. Every projection in the inner channel 23*c* extends to the terminus edge of slot 16*c*. Thus, when the cover 50 is positioned on top of a riser section 10, it is supported on the flat end surfaces 40*b* and 40*w* of the bosses 24 and webs 26 of riser section 10.

As in the riser section 10 one projection 42*c* is associated with each slot 16*c*. Thus, the blunt end 37 of a riser section with bosses 24 coacts with the channel end 27*c* of the cover 50 in the same way as the blunt end 37 of one riser coacts with the channel end 27 of another riser section 10. In the illustrated embodiment of cover 50 there are twenty-four slots spaced every 15° (degrees) about slotted wall portion 20*c*. There are also twenty-four projections 42*c*.

In the embodiment shown, six of the projections 42*c*, one located every 60° (degrees) about the channel 23*c*, are formed like the projections 42*b* of riser section 10. That is, each contains a hollow bore defining openings 52*c* at top surface 54 of the cover 50. These bores receive a screw (not shown) to secure the riser cover on a riser section 10 by connection to the hollow bores 40*h* in ends 40*b* of bosses 24 of a riser section 10.

Top surface 54 of the riser cover 50 is the same as the cover disclosed in U.S. Pat. No. 6,655,093 and is not disclosed in detail here. The disclosure of that patent is incorporated by reference.

Referring to FIGS. 6 and 7, concentric cylindrical walls 94 and 95 are formed on bottom surface 90, concentric with channel end 27*c* of riser cover 50. Provided on the bottom surface 90 are a plurality of vertically disposed support ribs 96, each extending radially out from the imaginary axis or centerline of the cover to the inner wall 22*c* of the cover channel end 27*c*. These ribs provide strength to the cover 50.

Within inner channel 23*c* there are provided spaced ribs 97 connected between slotted wall 20*c* and inner wall 22*c*. Because the embodiment illustrated is cylindrical the ribs 97 are radial. In a square shaped riser section and cover combination the ribs would be perpendicular to the walls defining the channel.

Two ribs 97 are positioned in pairs in association with each projection 42*c*, one on each side of each projection on each side of each slot 16. The ribs 97 transfer loads between the slotted middle wall 22*c* and inner wall 22*c*. The ribs 97 are of an axial length, within inner channel 23*c* that exceeds the length of projections 42. The pairs of ribs associated with each slot 16*c* are spaced apart further than the width of the slot at the edge 44*c* of slotted wall portion 20. When a cover 50 is positioned onto the blunt end 37 of a riser section 10, the ribs 97 of each pair associated with a projection 42*c* and slot 16*c* are disposed on either side of a boss 24 of the associated riser section 10.

It should be noted that ribs 97 of cover 50 can also be employed within the inner channel 23 of riser sections 10. Such ribs connect the segments of slotted middle wall portion 20 to the continuous inner wall portion 22 and add to load transfer capabilities. Such an arrangement is optional for the riser sections 10.

The riser section 10 and covers 50 embodying the present invention are made from molded high density polyethylene or other rigid polymeric material. The riser sections 10 are usually made in sizes 20 and 24 inches in diameter with a vertical sidewall height of about 6 to 9 inches. The sidewall thickness is about ⅜ inches.

Referring to FIGS. 4 and 5, in an actual embodiment, with a sidewall 12, that is 25½ inches in diameter with a height of six inches from downwardly facing flat annular surface 17 to flat annular edge surface 38. The parallel edges 16*p* of slots 16 are 0.272 inches in length, and are spaced apart a width WS which is 0.130 inches. The slots 16 diverge to 0.343 inches in width at the bottom edge 44 of middle wall 20 which is 24 inches in diameter. The total length of the slot from edge 44 of slotted middle wall portion 20 to the terminus edge at support surfaces 42*s* of projections 42 is 0.750 inches.

The width $W_w$ of web 26 at surface 40*w* is slightly less than the 0.130 inches width of slot at edges 16*p* so that the webs 26 fit easily into the slots 16. The molded parts are slightly tapered and the web width varies from 0.095 inches at surface 40*w* to 0.192 inches at the junction with ledge 28.

The distance between radial outer surfaces 24*f* of bosses 24 that face toward the inner surface 13 of sidewall 12 and the sidewall surface 13 is 0.169 inches at the surface 40*w*. It tapers somewhat and narrows to 0.073 inches at the horizontal ledge 28. The thickness of the slotted middle wall portion 20 is 0.110 inches. At the thickened wedge portion 20*p* the thickness is 0.153 inches so that it fits snugly into the gap between the facing surfaces 24*f* of a boss 24 and the inner surface 13 of the sidewall 12 with the wedge portions 20*p* frictionally engaged against the surfaces 24*f* on bosses 24.

The dimensions indicated above are of course, nominal or design dimensions and subject to molding tolerance. Also, the components generally taper slightly and increase in thickness from blunt end 37 toward the channel end 27 consistent with injection molding practices. Also, they are exemplary of riser sections and covers embodying the present invention. Other dimensions would be suitably incorporated in risers employing the same inventive principles.

Whereas the present invention is described herein with respect to specific embodiments thereof, it will be understood that various changes and modifications may be made by one skilled in the art without departing from the scope of the invention, and it is intended that the invention encompass such changes and modifications as fall within the scope of the appended claims.

What is claimed:

1. An access riser section comprising a single sidewall having a first end, a second end, and an inner surface;

said second end defining a channel end;

a plurality of vertical bosses extending along the inner surface of said sidewall;

said bosses connected to said sidewall by offsetting portions that are narrower than said bosses;

said channel end including wall portions defining a channel to receive bosses of another riser section;

one of said channel defining wall portions defining a plurality of slots open at an edge of said slot defining wall portion;

at least two of said slots including at least a portion defined by parallel edges formed by said slotted wall portion, the spacing of said parallel edges of said at least two slots being wider than the width of said offsetting portions and narrower than the width of said bosses;

said at least two slots adapted to receive offsetting portions of another riser section; and wherein said at least two slots further include diverging edges defined by said slotted wall portion extending from said parallel edges and forming a portion of each said slot that is progressively wider than the distance between said parallel edges from the juncture with said parallel edges to said open end of each said at least two slots at said edge of said slotted wall portion.

2. An access riser as claimed in claim 1 wherein said bosses terminate at said first end of said riser section in flat end surfaces and wherein said boss receiving channel includes a projection aligned with each slot defined by said slotted wall portion, said projections defining support surfaces adapted to be supported by the flat end surfaces of bosses of another riser section.

3. An access riser section as claimed in claim 2 wherein said offsetting portions terminate at said first end of said riser section in flat end surfaces and said slotted wall portion defines a terminus edge of each said slot at an end of said parallel edges said terminus edge being coplanar with the support surface of said projection associated with said slot, each said terminus edge adapted to be supported the flat end surface of an offsetting portion of another riser section.

4. An access riser section as claimed in claim 1 wherein said slotted wall portion includes a thickened wedge portion adjacent at least one of said slots, said thickened wedge portion adapted to contact a boss of another riser section.

5. An access riser section as claimed in claim 1 wherein said slotted wall portion includes a thickened wedge portion on each side of each said slot and each said thickened wedge portion is adapted to contact a boss of another riser section.

6. An access riser section as claimed in claim 1 wherein said sidewall is cylindrical.

7. An access riser section as claimed in claim 6 wherein said sidewall includes one boss every 15° about the inner surface of said sidewall.

8. An access riser section as claimed in claim 7 wherein said slotted wall portion defines a slot every 15°.

9. An access riser section as claimed in claim 8 wherein said bosses of a riser section are spaced midway between the slots defined by the slotted wall of said channel end.

10. An access riser section as claimed in claim 1 wherein said bosses have facing surfaces adjacent each side of said offsetting portion that connects said boss to said sidewall, said facing surfaces facing said sidewall, and wherein said slots are sized to receive the offsetting portions of another riser section with the slotted wall portion of the other riser section disposed between said facing surfaces and said sidewall.

11. An access riser section as claimed in claim 10 wherein said slotted wall portion includes thickened wedge portions adjacent at least one side of each said slot, said thickened wedge portion at each slot adapted to contact a boss of another riser section.

12. An access riser section as claimed in claim 11 wherein said slotted wall portion includes a number of slots equal to the number of bosses on said sidewall and a thickened wedge portion adjacent each side of each said slot.

13. A combination of stacked riser sections, each access riser section comprising a single sidewall having a first end, a second end, and an inner surface;

said second end defining a channel end;

a plurality of vertical bosses extending along the inner surface of said sidewall;

said bosses connected to said sidewall by offsetting portions that are narrower than said bosses;

said channel end including wall portions defining a channel to receive bosses of another riser section;

one of said channel defining wall portions defining a plurality slots open at an edge of said slot defining wall portion;

at least two of said slots including at least a portion defined by parallel edges formed by said slotted wall portion, the spacing of said parallel edges of said at least two slots being wider than the width of said offsetting portions and narrower than the width of said bosses;

said at least two slots adapted to receive offsetting portions of another riser section;

one of said riser sections disposed with the bosses thereof disposed in said channel of the other riser section and with offsetting portions disposed in said at least two of said slots of said other riser section; and wherein said at least two slots of each riser section further include diverging edges defined by said slotted wall portion extending from said parallel edges and forming a portion of each said slot that is progressively wider than the distance between said parallel edges from the juncture with said parallel edges to said open end of each said at least two slots at said edge of said slotted wall portion.

14. A combination of stacked riser sections as claimed in claim 13 wherein said bosses and offsetting portions of each said riser section terminate at said first end of said riser section in flat end surfaces and wherein said boss receiving channel includes a projection aligned with each slot defined by said slotted wall portion, said projections defining support surfaces to be supported by the flat end surfaces of bosses of another riser section, one of said riser sections disposed with said flat end surfaces of bosses supporting said support surfaces of said projections of the other riser section.

15. A combination of stacked riser sections as claimed in claim 14 wherein said offsetting portions terminate at said first end of said riser section in flat end surfaces and said slotted wall portion defines a terminus edge of each said slot at an end of said parallel edges, said terminus edge being coplanar with the support surface of said projection associated with said slot, each said terminus edge adapted to be supported by the flat end surface of an offsetting portion of another riser section, the flat end surfaces of said offsetting portions of one of said riser sections disposed on said terminus edges of slots of the other riser section.

16. A combination of stacked riser sections as claimed in claim 13 wherein said slotted wall portion of each said riser section includes a thickened wedge portion adjacent at least one of said slots, said at least one thickened wedge portion contacting a boss of the other riser section.

17. A combination of stacked riser sections as claimed in claim 16 wherein said slotted wall portion of each said riser section includes a thickened wedge portion on each side of each said slot contacting a boss of the other riser section.

18. A combination of stacked riser sections as claimed in claim 13 wherein said sidewall of each riser section is cylindrical.

19. A combination of stacked riser sections as claimed in claim 18 wherein said sidewall of each rising section includes one boss every 15° about the inner surface of said sidewall.

20. A combination of stacked riser sections as claimed in claim 19 wherein said slotted wall portion of each riser section defines a slot every 15°.

21. A combination of stacked riser sections as claimed in claim 20 wherein said bosses of each riser section are spaced midway between the slots defined by the slotted wall of said channel end.

22. A combination of stacked riser sections as claimed in claim 13 wherein said bosses of each said riser section have facing surfaces adjacent each side of said offsetting portion that connects said boss to said sidewall, said facing surfaces facing said sidewall, and wherein said slots are sized to receive the offsetting portions of another riser section with the slotted wall portion of the other riser section disposed between said facing surfaces and said sidewall and wherein one of said riser sections is disposed with the slotted wall thereof disposed between said facing surfaces and said side wall of the other of said riser section.

23. A combination of stacked riser sections as claimed in claim 22 wherein said slotted wall portion of each said riser section includes thickened wedge portions adjacent at least one side of each said slot, said thickened wedge portion at each slot adapted to contact a boss of another riser section.

24. A combination of stacked riser sections as claimed in claim 13 wherein said slotted wall portion of each said riser section includes a number of slots equal to the number of bosses on said sidewall and a thickened wedge portion on each side of each said slot with the thickened wedge portions of one of said riser sections contacting the bosses of the other riser section.

25. A combination cover and an access riser section having a plurality of vertical bosses extending along the inner surface of a sidewall;

said bosses connected to said sidewall by offsetting portions that are narrower than said bosses;

said cover having a channel end said channel end including wall portions defining a channel to receive bosses of said riser section;

one of said channel defining wall portions defining a plurality of slots open at an edge of said slot defining wall portion;

at least two of said slots including at least a portion defined by parallel edges formed by said slotted wall portion, the spacing of said parallel edges of said at least two of said slots being wider than the width of said offsetting portions and narrower than the width of said bosses;

said at least two of said slots receiving offsetting portions of said riser section; and said cover disposed on said riser section with said bosses received in said channel and said offsetting portions disposed in said at least two of said slots of said riser section; and wherein said at least two slots further include diverging edges defined by said slotted wall portion extending from said parallel edges and forming a portion of each said slot that is progressively wider than the distance between said parallel edges from the juncture with said parallel edges to said open end of each of said at least two slots at said edge of said slotted wall portion.

26. A combination cover and an access riser as claimed in claim 25 wherein said bosses terminate at said first end of said riser section in flat end surfaces and wherein said boss receiving channel includes a projection aligned with each slot defined by said slotted wall portion, said projections defining support surfaces supported by the flat end surfaces of bosses of said riser section.

27. A combination cover and an access riser as claimed in claim 26 wherein said offsetting portions terminate at said first end of said riser section in flat end surfaces and said slotted wall portion defines a terminus edge of each said slot at an end of said parallel edges said terminus edge being coplanar with the support surface of said projection associated with said slot, each said terminus edge supported by the flat end surface of one of said offsetting portions of said riser section.

28. A cover and an access riser as claimed in claim 25 wherein said slotted wall portion includes a thickened wedge portion adjacent at least one of said slots, said thickened wedge portion contacting a boss of said riser section.

29. A cover and an access riser as claimed in claim 25 wherein said slotted wall portion includes a thickened wedge portion on each side of each said slot each said thickened wedge portion contacting a boss of said riser section.

30. A cover and an access riser section as claimed in claim 25 wherein said cover and said sidewall are cylindrical.

31. A cover and an access riser section as claimed in claim 30 wherein said sidewall includes one boss every 15° about the inner surface of said sidewall.

32. A cover and an access riser section as claimed in claim 31 wherein said slotted wall portion defines a slot every 15°.

33. A cover and an access riser section as claimed in claim 32 wherein said bosses of said riser section are spaced midway between the slots defined by the slotted wall of said channel end.

34. A cover and an access riser section as claimed in claim 25 wherein said bosses have facing surfaces adjacent each side of said offsetting portion that connects said boss to said sidewall, said facing surfaces facing said sidewall, and wherein said slots are sized to receive the offsetting portions of said riser section with the slotted wall portion of the said channel end disposed between said facing surfaces and said sidewall of said riser section.

35. A cover and an access riser section as claimed in claim 34 wherein said slotted wall portion of said channel end includes thickened wedge portions adjacent at least one side of each said slot, said thickened wedge portion at each slot contacting a boss of said riser section.

36. A cover and an access riser section as claimed in claim 35 wherein said slotted wall portion of said channel end includes a number of slots equal to the number of bosses on said sidewall of said riser section and a thickened wedge portion adjacent each side of each said slot each thickened wedge portion contacting a boss of said riser section.

37. An access riser section as claimed in claim 25 wherein ribs are disposed in said channel, connected between said channel defining walls.

38. An access riser section as claimed in claim 37 wherein said ribs each are disposed on each side of each said slot.

39. An access riser section as claimed in claim 37 wherein said ribs are disposed in pairs associated with each said slot.

40. A combination cover and an access riser section as claimed in claim 25 wherein ribs are disposed in said channel of said cover connected to the channel defining walls.

41. A combination cover and access riser section as claimed in claim 40 wherein said ribs are disposed in pairs, associated with each said slot.

42. An access riser section as claimed in claim 39 wherein said ribs are radial.

43. An access riser section comprising a single sidewall having a first end, a second end, and an inner surface;

said second end defining a channel end;

a plurality of vertical bosses extending along the inner surface of said sidewall;

said bosses connected to said sidewall by offsetting portions that are narrower than said bosses;

said channel end including wall portions defining a channel to receive the bosses of another riser section;

one of said channel defining wall portions defining a plurality of slots open at an edge of said slot defining wall portion;

wherein said bosses have at least one facing surface adjacent the offsetting portion that connects said boss to said sidewall, said at least one facing surface facing said sidewall, and wherein said slots are sized to receive the offsetting portions of another riser with the slotted wall portion of the other riser disposed between said at least one facing surface of each said boss and said sidewall; and wherein said slotted wall portion includes thickened wedge portions adjacent at least one side of at least one of said slots, said thickened wedge portions adapted to contact said at least one facing surface of at least one boss of another riser section, wherein said thickened wedge portions are about 36% to 45% thicker than another portion of said slotted wall portion.

44. An access riser section as claimed in claim 43 wherein said bosses include a facing surface adjacent each side of said offsetting portions and said slotted wall portion includes a thickened wedge portion adjacent each side of each said slot, the wedge portions adjacent a slot adapted to frictionally contact the facing surfaces of a boss of another riser section.

45. A combination of stacked riser sections each comprising a single sidewall having a first end, a second end, and an inner surface;

said second end defining a channel end;

a plurality of vertical bosses extending along the inner surface of said sidewall;

said bosses connected to said sidewall by offsetting portions that are narrower than said bosses;

said channel end including wall portions defining a channel to receive the bosses of another riser section;

one of said channel defining wall portions defining a plurality of slots open at an edge of said slot defining wall portion;

wherein said bosses have at least one facing surface adjacent said offsetting portion that connects said boss to said sidewall, said facing surfaces facing said sidewall, and wherein said slots are sized to receive the offsetting portions of another riser with the slotted wall portion of the other riser disposed between said at least one facing surface of each said boss and said sidewall;

wherein said slotted wall portion includes at least one thickened wedge portion adjacent at least one side of at least one of said slots, said at least one thickened wedge portion adapted to contact said at least one facing surface of a boss of another riser section, wherein said at least one thickened wedge portion is about 36% to 45% thicker than another portion of said slotted wall portion; and wherein one of said riser sections is disposed with the bosses thereof in said channel of the other riser section with said at least one thickened wedge portion adjacent at least one side of said at least one slot of said other riser in contact with said at least one facing surface of a boss of the other riser section.

* * * * *